US005687899A

United States Patent [19]

Dohi et al.

[11] Patent Number: 5,687,899

[45] Date of Patent: Nov. 18, 1997

[54] PORTABLE FASTENER DRIVER USING INFLAMMABLE GAS

[75] Inventors: Yuji Dohi, Osaka, Japan; Ernest John Wendling, Vernon Hills, Ill.

[73] Assignee: Illinois Tool Works Inc., Glenview, Ill.

[21] Appl. No.: 635,018

[22] Filed: Apr. 19, 1996

[30] Foreign Application Priority Data

Apr. 19, 1995 [JP] Japan ..... 7-093929

[51] Int. Cl.[6] ..... B25C 1/08; B25C 5/13

[52] U.S. Cl. ..... 227/10; 227/8; 227/130

[58] Field of Search ..... 227/10, 8, 9, 129, 227/130, 131

[56] References Cited

U.S. PATENT DOCUMENTS

| | | | |
|---|---|---|---|
| 3,042,008 | 7/1962 | Liesse . | |
| 3,967,771 | 7/1976 | Smith | 227/10 |
| 4,218,888 | 8/1980 | Jayne | 227/10 X |
| 4,403,722 | 9/1983 | Nikolich | 227/10 X |
| 4,405,072 | 9/1983 | Kindle et al. | 227/10 |
| 4,483,473 | 11/1984 | Wagdy | 227/10 X |
| 4,483,474 | 11/1984 | Nikolich | 227/10 X |
| 4,717,060 | 1/1988 | Cotta | 227/10 |
| 4,721,240 | 1/1988 | Cotta | 227/10 |
| 4,883,942 | 11/1989 | Robak et al. | 219/227 |
| 4,905,634 | 3/1990 | Veldman | 227/10 X |
| 5,388,749 | 2/1995 | Davignon et al. | 227/67 |

FOREIGN PATENT DOCUMENTS

| | | |
|---|---|---|
| 0 169 003 | 1/1986 | European Pat. Off. . |
| 0 544 471 | 6/1993 | European Pat. Off. . |
| 0 597 241 | 5/1994 | European Pat. Off. . |
| 2715696 | 8/1995 | France . |
| 1664543 | 7/1991 | U.S.S.R. . |

*Primary Examiner*—Joseph J. Hail, III
*Assistant Examiner*—Jay A. Stelacone
*Attorney, Agent, or Firm*—Schwartz & Weinrieb

[57] ABSTRACT

A gas type fastener driver 1 is supplied with electric power from an external power source 55 through an electric cord 53. When a trigger 45 is pulled to turn a switch 47 on, the external electric power is supplied to an ignition plug 17 to burn gas in a combustion chamber 14. Combustion gas pushes a piston 11 forward to drive a nail n by a driving rod 12 connected to the piston 11.

20 Claims, 8 Drawing Sheets

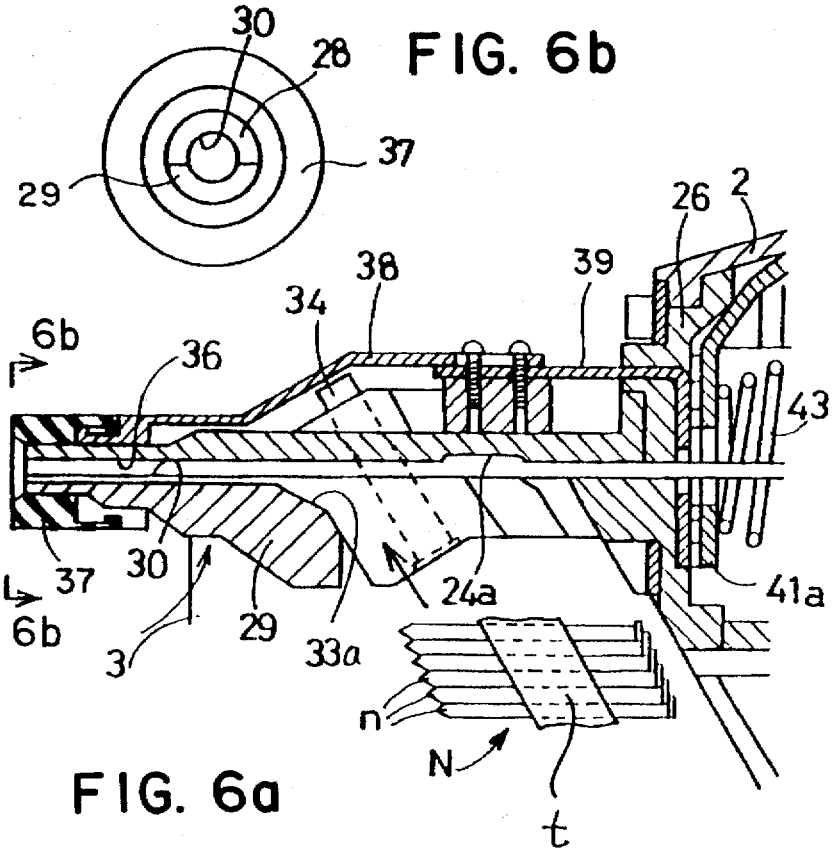
FIG. 6b
FIG. 6a
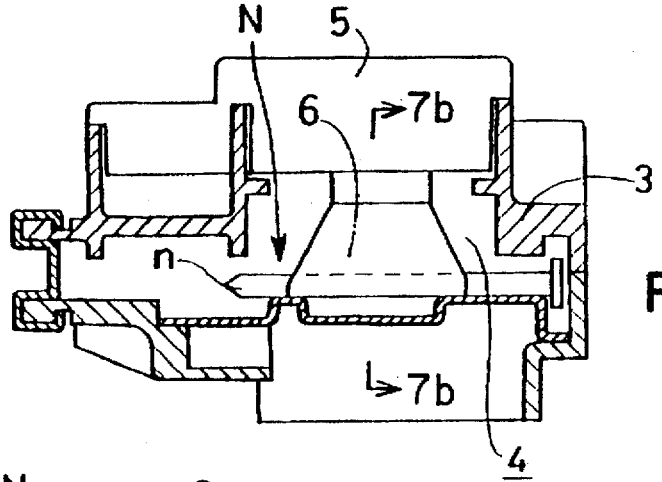
FIG. 7a
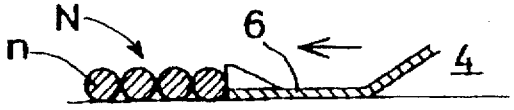
FIG. 7b

PORTABLE FASTENER DRIVER USING INFLAMMABLE GAS

FIELD OF THE INVENTION

The present invention relates to a portable fastener driver for driving a fastener such as a nail, rivet or staple by utilizing the combustion of an inflammable gas.

BACKGROUND OF THE INVENTION

In general, a fastener driver for driving a nail, rivet, or staple is usually to an electric type driver utilizing electromagnetic phenomena, a hydraulic type driver using compressed air, or a gas type driver utilizing liquefied gas such as MPAA gas, propane gas or butane gas filled in a pressure container. An example of the gas type fastener driver is disclosed in Japanese Patent Publication No. H4-11337.

Among others, the electric type fastener driver usually uses a commercial power source of 100V. Therefore, the driving power of the electric type driver is relatively low and its application is limited to a staple driver for fixing a plywood board or fixing a metal mesh as a base of a mortar wall. Thus, the hydraulic type or the gas type fastener driver has been used as a riveter which must be more powerful.

In the hydraulic type riveter, however, an air compressor must be provided separately. Therefore, it is troublesome to move and/or maintain the hydraulic type riveter with the air compressor. In addition thereto, an air hose connecting the air compressor and the riveter may disturb the work of an operator of the riveter.

On the other hand, the gas type riveter does not require such compressor and hose and, therefore, has no such problem inherent to the hydraulic type riveter.

The gas type riveter is adapted to push a rivet forward by a forward movement of a driving rod fixed to a piston in a cylinder of the riveter, which is caused by igniting gas filling the cylinder by means of an ignition plug. It has been usual that the ignition plug is supplied with electric current from a power source such as a rechargeable battery or dry cells provided in the riveter as disclosed in the above mentioned Japanese Patent Publication or Japanese Patent Publication No. H3-25307.

It has been known that the power source voltage to be used for the ignition plug of the riveter must be at least 6V. Further, since the capacity of such power source must be large enough to allow a continuous use of the riveter, the weight and size of the power source and hence the riveter become considerable. Further, a recharging operation or an exchange of dry cells is troublesome. In the case of the rechargeable battery, a battery charger is required, resulting in an increase of cost.

OBJECT OF THE INVENTION

An object of the present invention is to provide a gas type portable fastener driver which is free from the above mentioned problems of the conventional gas type fastener driver.

SUMMARY OF THE INVENTION

In order to achieve the above object, a portable fastener driver according to the present invention comprises a housing, a cylinder provided in the housing and supporting a piston slidably therein, a space provided in the housing for receiving a liquefied gas container for supplying inflammable gas into the cylinder, an ignition plug for igniting gas filling the cylinder, a driving rod fixed to a front end of the piston such that the driving rod is driven forward and out of the cylinder by a forward movement of the piston caused by combustion of the gas in the cylinder, a fastener magazine provided in front of the driving rod in a fully retracted state for supplying fasteners to be driven one by one by the forward movement of the driving rod, and an electric cord for supplying an electric current from an external power source to the ignition plug.

Since the construction of the portable fastener driver according to the present invention does not require a battery provided therein, the fastener driver can be made light weight and compact compared with the conventional driver and, since there is no need for a recharging operation or a battery exchanging operation, the maintenance of the fastener driver is facilitated.

On the other hand, since the electric cord is light weight and is easy to handle contrary to the air hose of the hydraulic type fastener driver, and since it is easy to move about a working area by using an extension cord or to change working areas by plugging the extension cord into a different electrical outlet, the use of the electric cord does not disturb the use of the fastener driver.

Therefore, according to the present invention, the gas type fastener driver can be made light weight and compact without degrading the usability thereof and thus the maintenance thereof can be facilitated.

In addition, since there is no need of using a battery recharger, the cost of the fastener driver can be reduced.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein:

FIGS. 1(*b*) and 1(*c*) are front views of different nail cartridges, respectively;

FIG. 4(*b*) is an enlarged view of a portion of the fastener driver shown in FIG. 4(*a*), showing the operation of a valve;

FIG. 5(*b*) is a cross section taken along the line 5*b*—5*b* in FIG. 5(*a*);

FIG. 5(*c*) is a cross section taken along the line 5*c*—5*c* in FIG. 5(*a*);

FIG. 5(*d*) is a cross section showing the positioning pin;

FIG. 6(*a*) is a cross sectional side view of the front portion of the fastener driver;

FIG. 6(*b*) is a cross section taken along the line 6*b*—6*b* in FIG. 6(*a*);

FIG. 7(*a*) is a cross section taken along the line 7—7 in FIG. 2;

FIG. 7(*b*) is a cross section taken along the line 7*b*—7*b* in FIG. 7(*a*);

FIG. 10(*b*) shows a third of the electrical connection of the present invention;

FIG. 12(*b*) is a cross section with a solid pin being set.

DETAILED DESCRIPTION OF THE ILLUSTRATED EMBODIMENTS

Figure 1A:
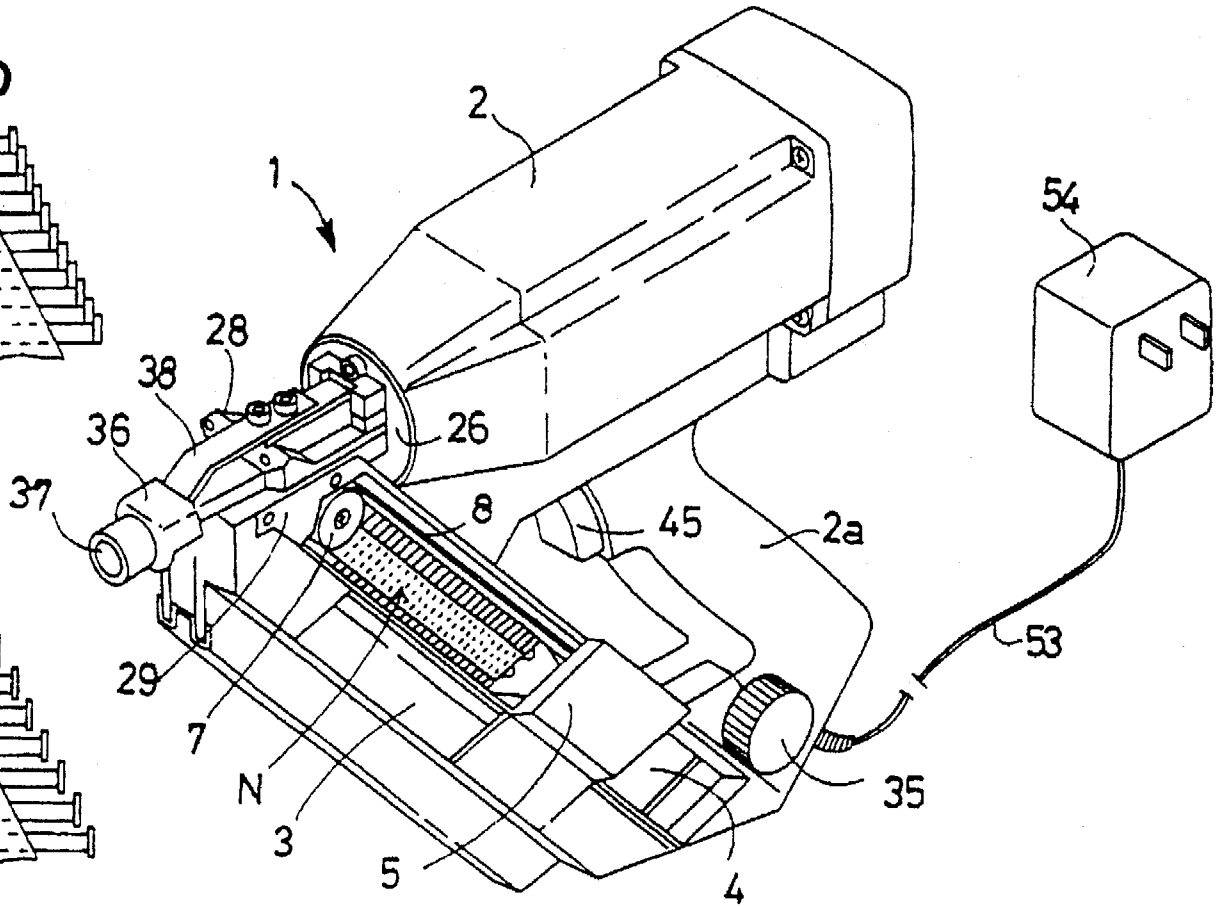
FIG. 1(*a*) is a perspective view of a fastener driver according to an embodiment of the present invention.
Figure 1B:
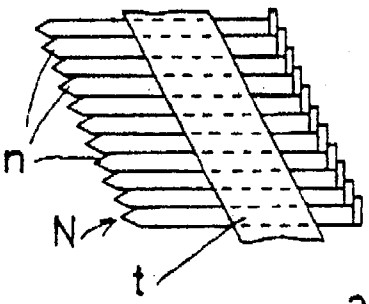
Figure 1C:
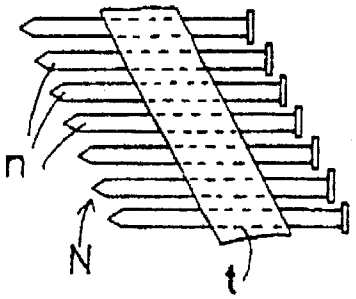
Figure 2:
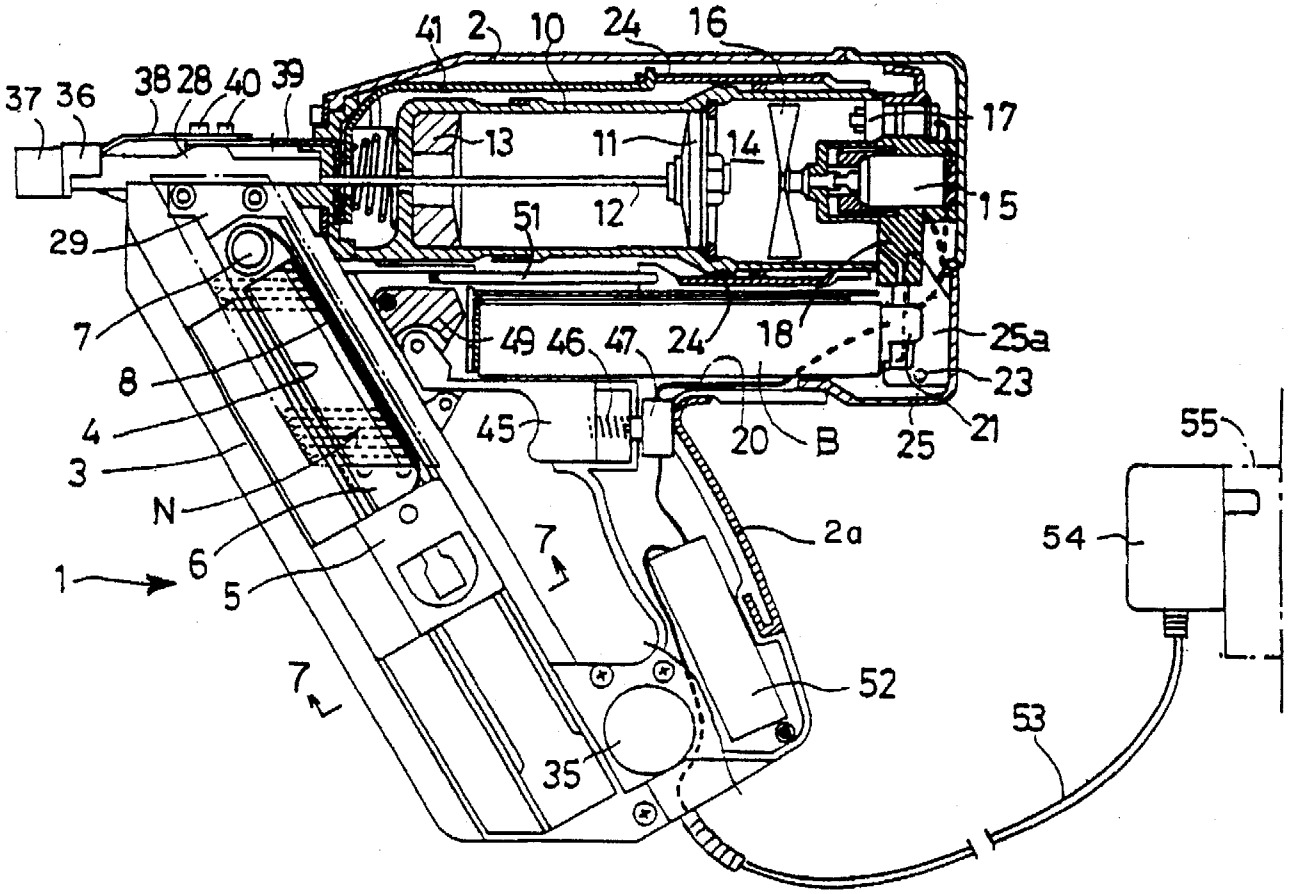
FIG. 2 is a partially cross-sectioned side view of the fastener driver.
Figure 3:
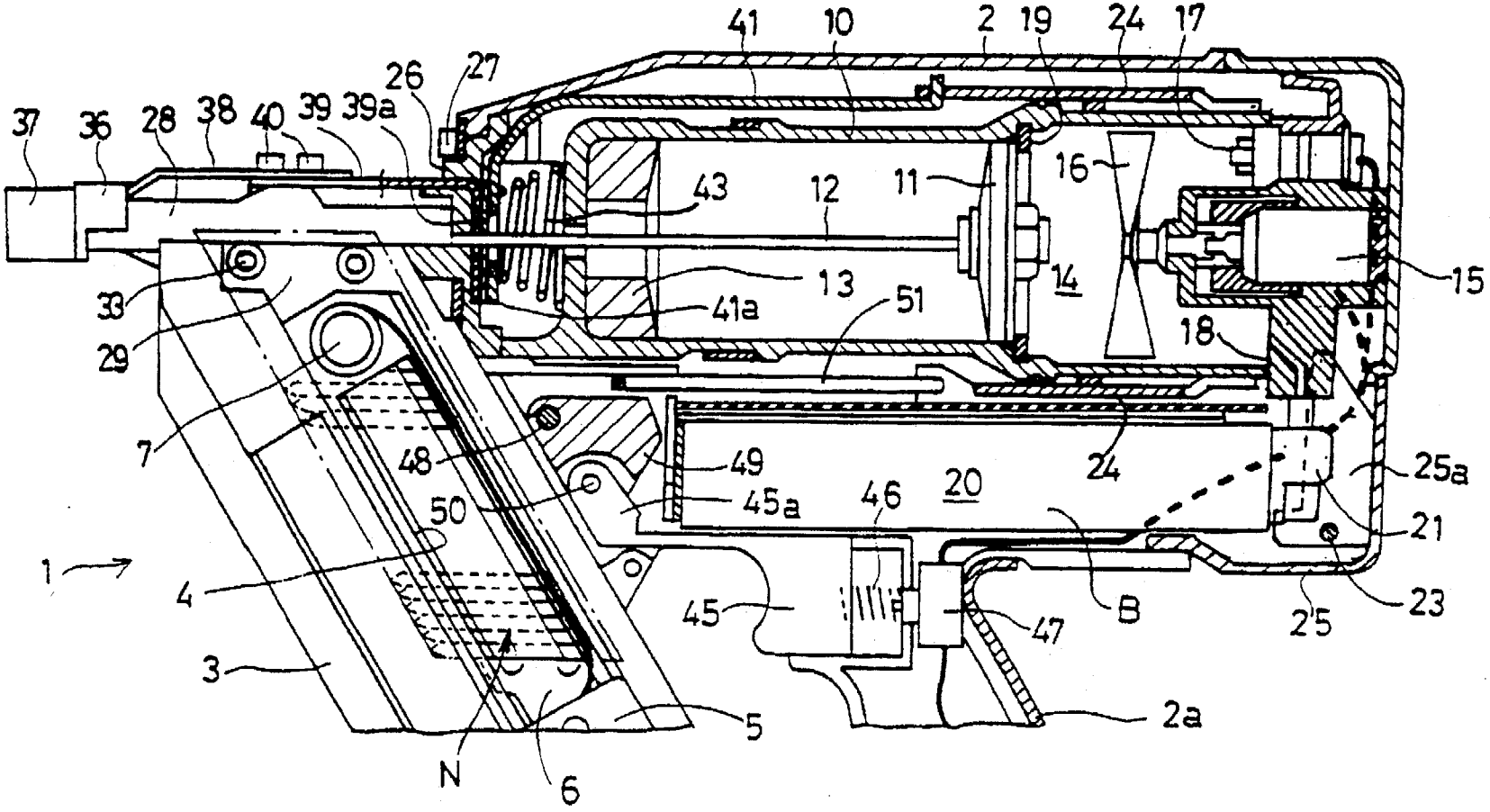
FIG. 3 is a partially cross-sectioned side view of an upper portion of the fastener driver.
Figure 4A:
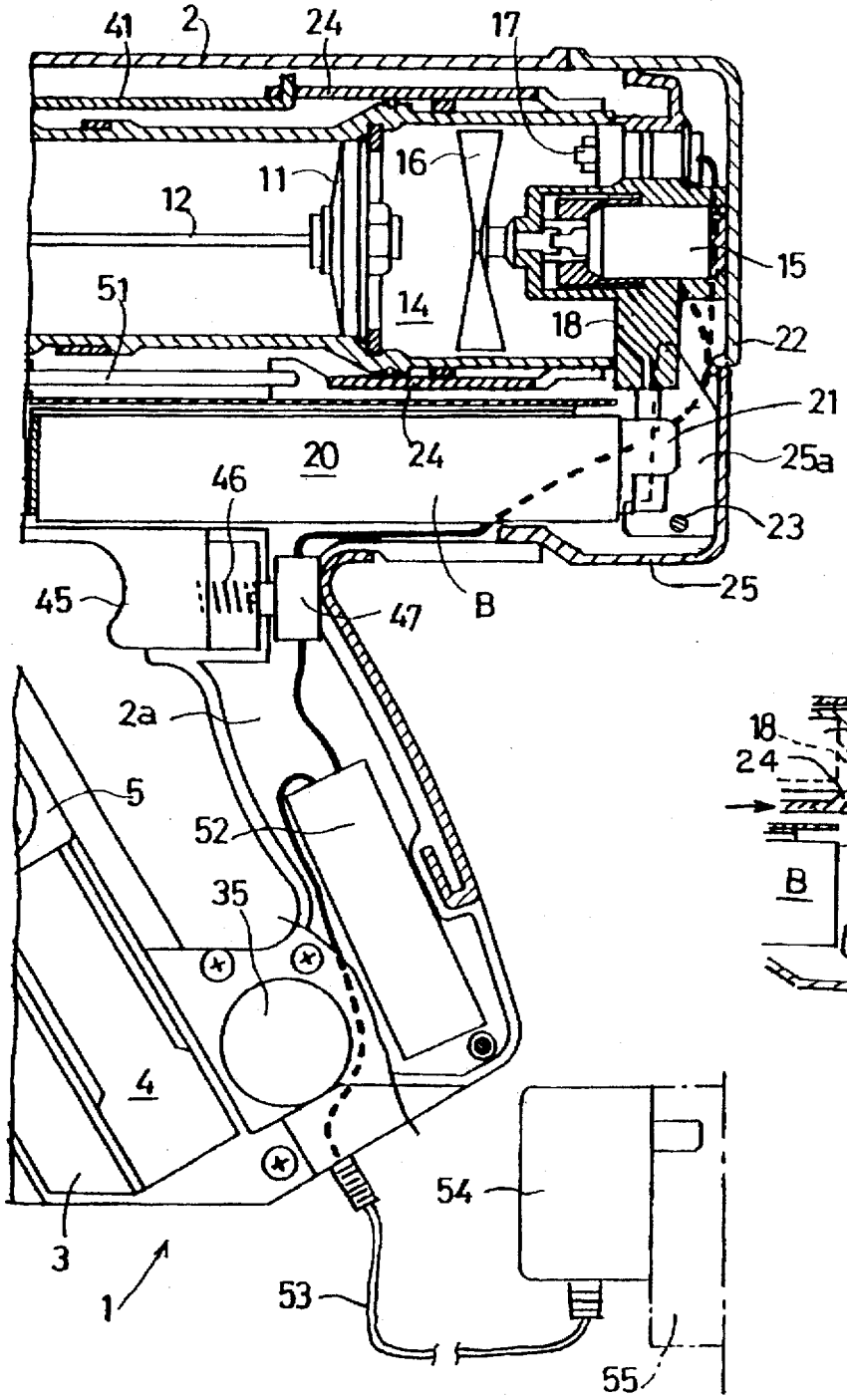
FIG. 4(*a*) is a partially cross-sectioned side view of a rear portion of the fastener driver.
Figure 4B:
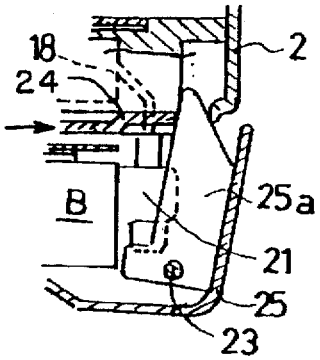
Figure 5A:
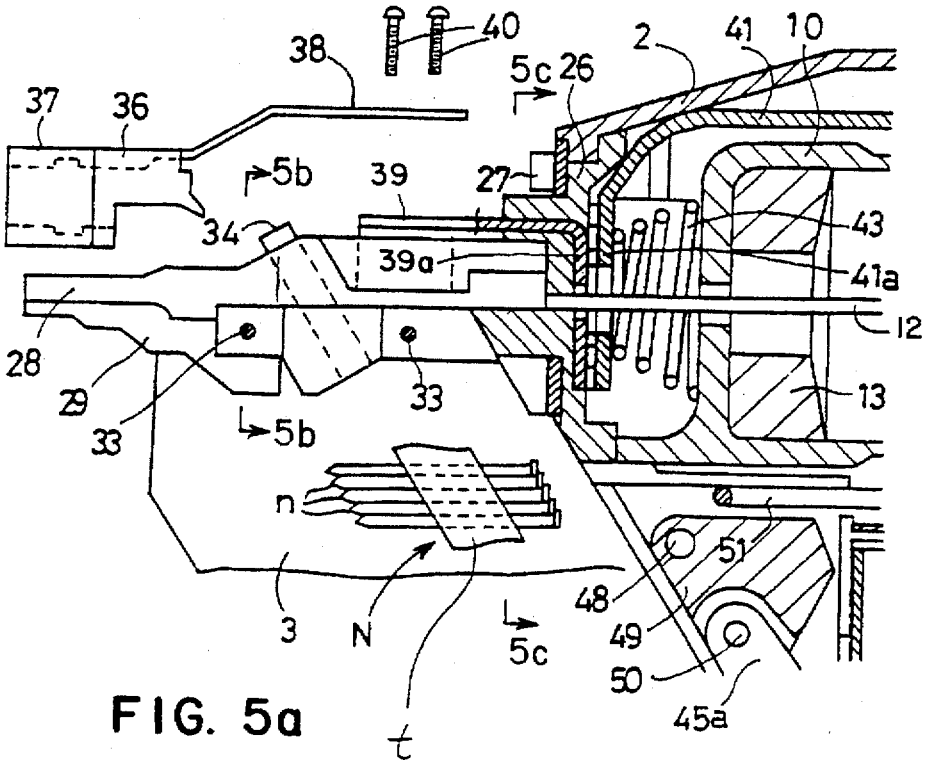
FIG. 5(*a*) is a partially disassembled, partially cross-sectioned side view of a forward portion of the fastener driver.
Figure 5B:
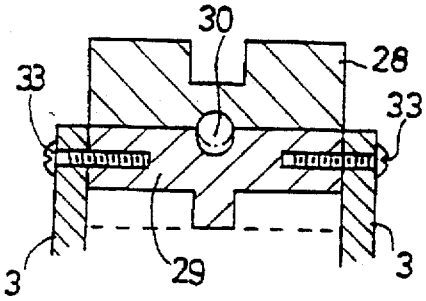
Figure 5C:
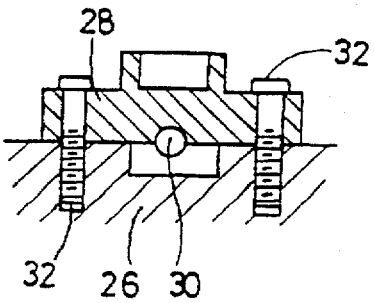
Figure 5D:
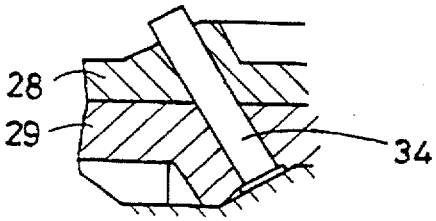

A first embodiment of the gas type fastener driver according to the present invention will be described in detail with reference to FIGS. 1 to 9, in which FIG. 1(*a*) is a perspective view showing the overall construction of a fastener driver 1, FIG. 2 is a cross section thereof, and FIGS. 3 and 4 are partial cross sections of various portions thereof.

The gas type fastener driver 1 includes a housing 2 and a grip 2*a* attached to a lower surface of the housing 2. A fastener magazine 3 loaded with a plurality of fasteners which are, in this embodiment, nails n is arranged in front of the grip 2*a* and is attached to a front surface of the housing 2 at an angle with respect to an axis of a driving rod to be described later.

The nails n are arranged in parallel and supported by a paper tape t. The nails n can be arranged tightly in parallel by partially removing head portions thereof as shown in FIG. 1(*b*) or arranged in parallel with a space between adjacent nails as shown in FIG. 1(*c*), so that the nails n form a flat nail strip N.

FIG. 7(*a*) is a cross section taken along the line 7—7 in FIG. 2 and FIG. 7(*b*) is a cross section taken along the line 7*b*—7*b* in FIG. 7(*a*). As is clear from FIGS. 7(*a*) a 7(*b*), the magazine 3 defines a space 4 therein which extends along the magazine into which the nail strip N is inserted. Further, a magazine follower 5 having a push-up member 6 which is in contact with the lowest nail n of the nail strip N is slidably inserted into the space 4 of the magazine 3.

As shown in FIGS. 1 to 3, a roller 7 is provided in an upper portion of the magazine 3. The roller 7 is rotatable about an axis extending in the width direction of the magazines. An end of a coiled leaf spring 8 is fixed to the roller 7 and the coiled spring 8 is wound on the roller 7. The other end of the spring 8 is fixed to the magazine follower 5. The spring 8 wound on the roller 7 biases the magazine follower 5 upwardly such that the magazine follower 5 always pushes the nail strip N up.

As shown in FIG. 3, a cylinder 10 is provided within the housing 2, which extends longitudinally of the housing 2. A piston 11 is slidably inserted into the cylinder 10. A driving rod 12 for driving the uppermost nail n of the nail strip N forward is suitably fixed to the front end of the piston 11. An elastic member 13 such as rubber for absorbing mechanical shock and rebounding the piston 11 is provided in a front end portion of the cylinder 10.

Behind the cylinder 10, a combustion chamber 14 having a diameter larger than that of the cylinder 10 is formed and a fan 16 driven by a motor 15 for agitating gas in the combustion chamber 14 is provided in a rear portion of the combustion chamber 14. An ignition plug 17 is provided above the motor 15 and a gas hole 18 is formed below the motor 15. A snap-ring 19 for preventing the piston 11 from moving into the combustion chamber 14 is provided between the cylinder 10 and the combustion chamber 14.

A space 20 for receiving a gas container B filled with liquid gas such as liquid propane or butane gas is formed in a boundary portion between the cylinder 10 and the grip 2*a*. A valve 21 for discharging a constant amount of gas from the gas container B is provided upon a rear end portion of the gas container B. A nozzle provided inside of the valve 21 is connected to the gas hole 18 such that the latter is communicated with the nozzle when the nozzle is pushed up to supply the constant amount of gas to the combustion chamber 14.

The space 20 is opened rearward of the housing 2 and an openable cover 25 covers the opening. The cover 25 is rotatably supported by a pin 23 extending perpendicularly to the drawing sheet as shown in FIGS. 2 to 4 such that the cover 25 can tilt backward about the pin 23.

The cover 25 is formed with a pressing portion 25*a* for pushing the nozzle of the valve 21 upwardly. When a sleeve 24 which is fitted in the cylinder 10 as to be described later is retracted as shown in FIG. 4(*b*), the pressing portion 25*a* is tilted backward about the pin 23 to push the nozzle of the valve 21 upwardly so as to thereby discharge the constant amount of gas to the combustion chamber through the gas hole 18.

The construction of the forward portion of the fastener driver 1 will now be described with reference to FIGS. 5 and 6, in which FIG. 5(*a*) is a partially disassembled, partially cross-sectioned side view of a forward portion of the fastener driver, FIG. 5(*b*) is a cross section taken along the line 5*b*—5*b* in FIG. 5(*a*), FIG. 5(*c*) is a cross section taken along the line 5*c*—5*c* in FIG. 5(*a*), FIG. 5(*d*) is a cross section showing a positioning pin, FIG. 6(*a*) is a cross sectional side view of the front portion of the fastener driver and FIG. 6(*b*) is a cross section taken along the line 6*b*—6*b* in FIG. 6(*a*).

A cover plate 26 is fixed to the front face of the housing 2 by a screw 27 and a pair of upper and lower guide members 28 and 29 for guiding the uppermost nail n of the nail strip N are arranged in front of the cover plate 26. As shown in FIG. 5(*c*), mating surfaces of the upper and lower guide members 28 and 29 are formed with semi-circular grooves which, when assembled with each other, form a guide passage 30 having a cross sectional shape coaxial to the driving rod 12. Further, as shown in FIG. 6*a*, a rear end portion of the semi-circular groove of the lower guide member 29 is tapered to form a notch 33*a* for receiving an upper portion of the nail strip N which is biased upward in the magazine 3 for upwardly and smoothly guiding the uppermost nail n.

The upper guide member 28 is fixed to the cover plate 26 by a set of screws 32 as shown in FIG. 5(*c*) and the lower guide member 29 is fixed to an upper end face of the magazine 3 by a set of screws 33 as shown in FIG. 5(*b*).

Further, as shown in FIGS. 5(*a*) and 5(*d*), a pair of right and left positioning pins 34 protrude from the lower guide member 29 in parallel to the front face of the housing 2 and pass through the upper guide member 28. On the other hand, a lower portion of the magazine 3 is slidably fitted in a lower end of the grip 2*a* and the lower end of the magazine 3 and the grip 2*a* are fixed to each other by a knob 35 having a bolt.

Therefore, by untightening the knob 35, the magazine 3 can slide down along the front face of the housing 2 in an oblique manner so as to widen the gap between the upper and lower guide members 28 and 29 and thereby remove a nail n when the latter is jammed. When the knob 35 is removed from the housing, the magazine 3 can be removed from the housing 2.

A cylindrical nose member 36 is slidably fitted on front end portions of the upper and lower guide members 28 and 29 to hold the guide members 28,29 in their mating relation. On the nose member 36, a protective cylinder 37 of a non-metallic material such as plastic is fitted.

Further, an upper probe 38 extending rearward along the upper surface of the upper guide member 28 is provided and a lower probe 39 passing into the cover plate 26 on the front face of the housing 2 is fixed to the upper probe 38 by a screw 40.

A rear end of the lower probe 39 is formed with a vertical portion 39*a* which intimately contacts an inner face of the cover plate 26 and the vertical portion 39*a* is formed with a through-hole through which the driving rod 12 passes.

As shown in FIG. 3, the sleeve 24 slidably covers the rear half portion of the cylinder 10 and a gang plate 41 extending forwardly engages the front upper end of the sleeve 24. A vertical portion 41*a* of the gang plate 41 which overlaps the vertical portion 39*a* of the lower probe 39 through means of a spacer is formed on a front end of the gang plate 41 and a spring 43 is provided between the vertical portion 41*a* of the gang plate 41 and the front face of the cylinder 10.

Therefore, by urging the fastener driver 1 toward a member to be fastened, with the nose member 36 being in contact with the member so as to retract the nose member 36 against the spring 43, the sleeve 24 is retracted through the upper and lower guide members 28 and 29 and the gang plate 41. With the sleeve 24 being retracted, the pressing portion 25*a* of the cover 25 is tilted backwardly so as to push the nozzle of the valve 21 upwardly were by a constant amount of gas is discharged from the gas container B into the combustion chamber 14, as described with reference to FIG. 4(*b*).

The grip 2*a* of the housing 2 is constituted by left and right halves and a space is defined between the halves. A trigger 45 is mounted in an upper portion of the grip 2*a* and is biased forward by a spring 46. A switch 47 is provided behind the trigger 45 such that, when the trigger 45 is fully pulled, the switch 47 is turned ON to make an electric circuit for energizing the ignition plug 17 and the motor of the fan 16.

Figure 8:
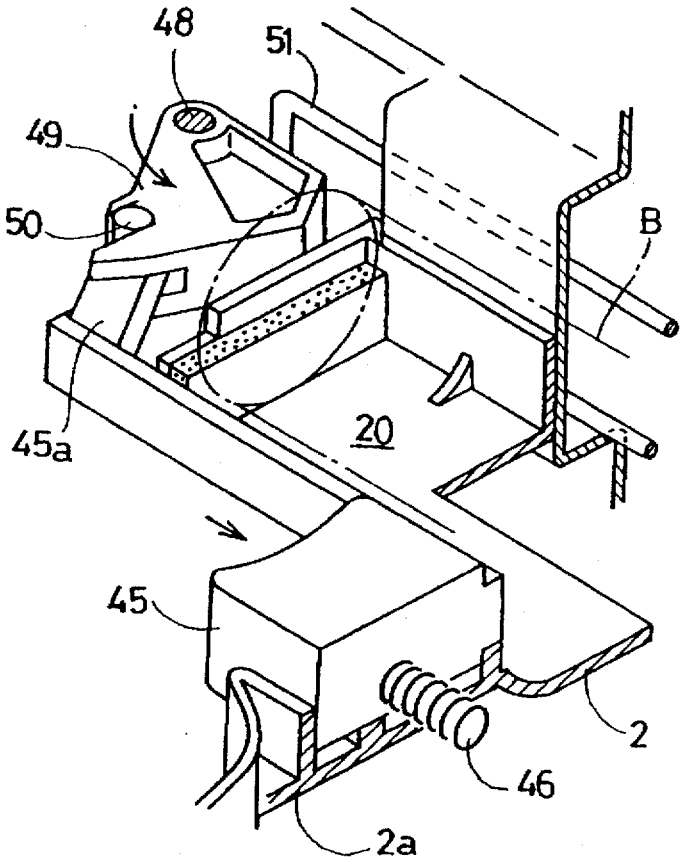
FIG. 8 is a perspective view showing the mounting of a trigger.
Figure 9:
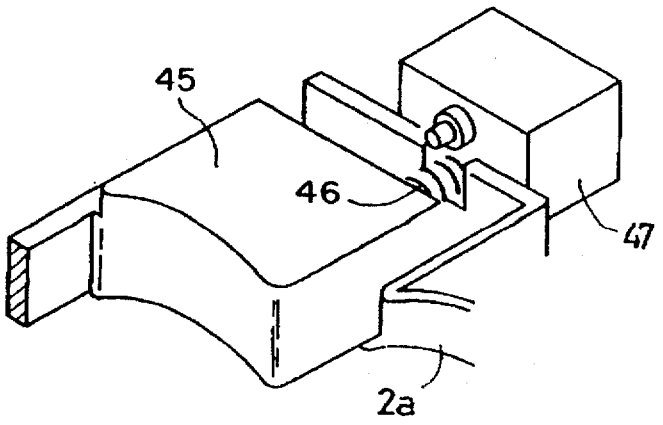
FIG. 9 is a perspective view of the mounting of the trigger as seen from another side thereof.

As shown in FIGS. 3 and 8, a forward extension 45*a* extending to a front portion of the space 20 is formed on an upper portion of the trigger 45. A cam 49 is rotatably supported by a horizontal pin 48 in a forward portion of the space 20 of the housing 2. An end portion of the forward extension 45*a* of the trigger 45 is rotatably engaged with a lower portion of the cam 49 by a pin 50 such that, when the trigger 45 is pulled, the cam 49 rotates.

Further, as shown in FIGS. 3 and 8, a stopper 51 formed by bending a wire into a generally U shape is fixed to a front lower portion of the sleeve 24, with a bottom portion of the U shaped stopper being positioned on an upper surface of the cam 49.

Therefore, in the state where the nose member 36 is extended forward, the sleeve 24 is moved forward. Thus, the rotation of the cam 49 is blocked by the stopper 51 so as to prevent the trigger 45 from being pulled. On the other hand, when the nose member 36 is urged toward the member to be fastened so as to retract the nose member 36 relative to the housing 2, the sleeve 24 and the stopper 51 are retracted to allow the cam 49 to rotate. Therefore, it is possible to turn the switch 47 on by pulling the trigger 45.

As mentioned, the nose member 36, the gang plate 41, the sleeve 24, the stopper 51 and the cam 49 constitute a safety mechanism for preventing the nail n from being driven unless the nose member 36 is urged toward the member to be fastened.

A control box 52 containing a circuit breaker and a transformer and the like is arranged in the grip 2*a*. One end of a conductor cord 53 is connected to the control box 52 and the other end thereof is led out from a lower face of the grip 2*a* and connected to a plug 54 having a rectifying and transforming function of converting a commercial A.C. 100V to a D.C. of about 6V. Electrical connections between the control box 52 and the switch 47 and between the switch 47 and the ignition plug 17 and the motor 15 for the fan 16 are of course provided.

With the above mentioned construction, when the plug 54 is plugged into an electrical outlet or the like 55 provided on a wall of a building, or similar structure, electric power is supplied to the fastener driver 1. Under this condition, when the trigger 45 is pulled with the nose member 36 being urged toward the member to be fastened, a constant amount of gas is supplied to the combustion chamber 14 and, simultaneously, the switch 47 is turned ON to supply electric current to the ignition plug 17 to burn the gas to thereby drive the piston 11 and hence the driving rod 12 forward. Thus, the uppermost nail n of the nail strip N is driven.

Since electric power is supplied externally through the cord 53, there is no need of providing a battery within the fastener driver 1 and it is possible to make the driver light weight and compact. Further, the fastener driver of the present invention is free from a battery recharging operation or battery change operation. Further, since the cord 53 itself is light weight, it does not adversely affect the work. By using an extension cord or changing the position of the outlet or other source of electrical power 55, it is possible to easily change the working area. Therefore, the merits of the portable fastener driver, that is, the mobility and the usability, are satisfied.

Figure 10A:
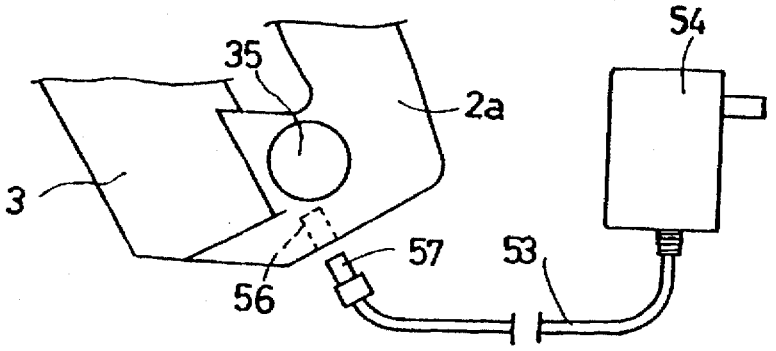
FIG. 10(*a*) shows a second embodiment of the electrical connection of the present invention.
Figure 10B:
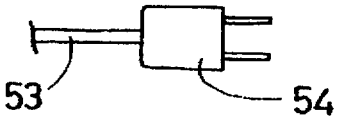

In the first embodiment, the electric power is supplied to the fastener driver 1 through the cord 53. In a second embodiment shown in FIG. 10(*a*), a jack 56 is provided in a suitable position of the grip 2*a* and a plug 57 connected to the plug 54 is inserted into the jack 56. The plug 54 may be one having no rectifying and transforming functions as shown in FIG. 10(*b*). However, the plug 54 having such functions may be preferable when considering the weight of the fastener driver 1 since there is no need of providing a rectifier and a transformer in the fastener driver 1.

Figure 11B:
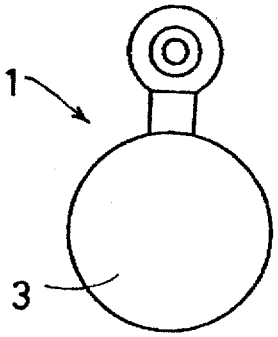
FIGS. 11(*a*) and 11(*b*) are a right side view and a front view of a modification of the present invention, respectively.
Figure 11A:
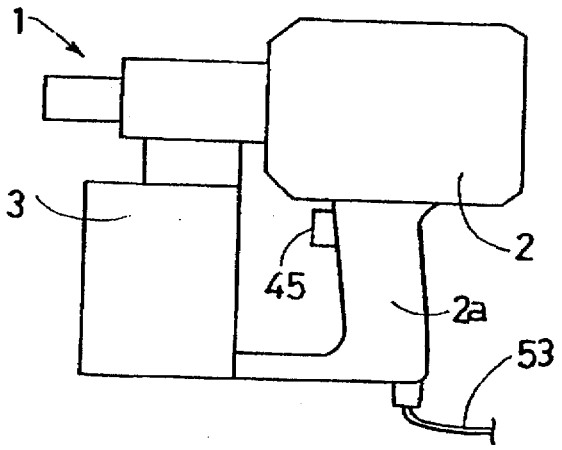

FIG. 11 schematically shows another embodiment of the fastener driver 1. In FIG. 11, a number of parallel nails are fixed on wires or a tape and the wires or the tape is rolled to form a roll of nails and the roll of nails are loaded in a drum shaped magazine 3. The principle of driving the nail is the same as that mentioned in the first embodiment.

Figure 12A:
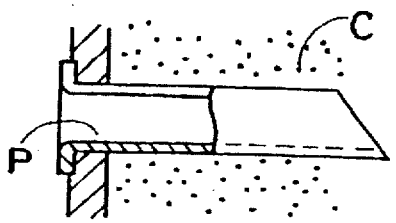
FIG. 12(*a*) is a cross section showing a hollow pin being set.
Figure 12B:
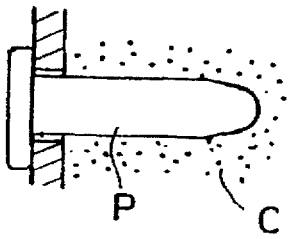

Although the present invention has been described when applied to a nail driver, the present invention can be used for driving various fasteners such as those for tightening or fixing a member. For example, as shown in FIG. 12(*a*), the present invention can be applied to drive a hollow pin P into a concrete structure C or a brick or to drive a solid pin P as seen in FIG. 12(*b*). Further, the present invention can be applied to a riveter or to a fastener driver for driving a pin into a relatively thin metal plate.

What is claimed is:

1. A portable fastener driver tool, comprising a housing having handle means provided thereon;

a combustion chamber provided within said housing a fuel container disposed within said housing for supplying fuel into said combustion chamber of said housing;

an ignition plug for igniting said fuel conducted into said combustion chamber of said housing;

a driving rod movably disposed within said housing such that said driving rod is driven forward along a drive axis and out of said housing as a result of the combustion of said fuel conducted into and ignited within said combustion chamber of said housing;

fastener magazine means provided in front of said driving rod, when said driving rod is disposed in a fully retracted state, for serially supplying fasteners one by one to said drive axis such that said fasteners can be serially driven as a result of the successive forward movements of said driving rod;

electrical switch means mounted upon said handle means of said housing for movement between ON and OFF states; and an electric cord having one end thereof operatively connected to a power source which is external of said tool for receiving electrical power from said external power source, and an opposite end thereof operatively connected to said housing for supplying said electrical power to said ignition plug through said electrical switch means when said electrical switch means is disposed in said ON state.

2. The tool as set forth in claim 1, further comprising:

fan means disposed within said combustion chamber for agitating gases within said combustion chamber.

3. The tool as set forth in claim 2, further comprising:

electric connection means connecting said fan means to said electrical switch means such that said electrical switch means controls the supply of said electrical power to both said ignition plug and said fan means.

4. The tool as set forth in claim 1, further comprising:

trigger means mounted upon said handle means and operatively connected to said electrical switch means for activating said electrical switch means and said tool when a fastener is to be driven by said driving rod of said tool and into a substrate; and means axially movable upon said housing between extended and retracted positions, and operatively associated with said trigger means, for preventing movement of said trigger means and actuation of said electrical switch means when said axially movable means is not engaged with a substrate into which a fastener is to be driven whereby said axially movable means is disposed at said extended position, and for permitting movement of said trigger means and actuation of said electrical switch means when said axially movable means is engaged with a substrate into which a fastener is to be driven whereby said axially movable means is disposed at said retracted position.

5. The tool as set forth in claim 4, wherein:

a rotary cam member is pivotally mounted within said housing;

said trigger means comprises an extension portion which is pivotally connected to said rotary cam member such that when said trigger means is pulled so as to activate said electrical switch means, said rotary cam member will be pivoted from a first non-activated position, corresponding to a first non-activated position of said trigger means, to a second activated position corresponding to a second activated position of said trigger means; and said axially movable means blockingly engages said rotary cam member when said axially movable means is disposed at said extended position so as to prevent pivotal movement of said rotary cam member from said first non-activated position to said second activated position so as to in turn prevent movement of said trigger means from said non-activated position to said activated position, while when said axially movable means is disposed at said retracted position, said rotary cam member does not engage said axially movable means whereby said rotary cam member and said trigger means are able to be moved to their respective activated positions.

6. The tool as set forth in claim 1, wherein:

said fuel container contains a liquid fuel and comprises nozzle means for discharging said liquid fuel through an end wall of said combustion chamber.

7. The tool as set forth in claim 6, wherein:

said liquid fuel comprises one of liquid propane and liquid butane.

8. The tool as set forth in claim 1, further comprising:

trigger means mounted upon said handle means and operatively connected to said electrical switch means for activating said electrical switch means and said tool when a fastener is to be driven by said driving rod of said tool into a substrate; and means axially movable upon said housing between extended and retracted positions, and operatively associated with said trigger means, for preventing movement of said trigger means and actuation of said electrical switch means when said axially movable means is not engaged with a substrate into which a fastener is to be driven whereby said axially movable means is disposed at said extended position, and for permitting movement of said trigger means and actuation of said electrical switch means when said axially movable means is engaged with a substrate into which a fastener is to be driven whereby said axially movable means is disposed at said retracted position.

9. The tool as set forth in claim 8, wherein:

a rotary cam member is pivotally mounted within said housing;

said trigger means comprises an extension portion which is pivotally connected to said rotary cam member such that when said trigger means is pulled so as to activate said electrical switch means, said rotary cam member will be pivoted from a first non-activated position, corresponding to a first non-activated position of said trigger means, to a second activated position corresponding to a second activated position of said trigger means; and said axially movable means blockingly engages said rotary cam member when said axially movable means is disposed at said extended position so as to prevent pivotal movement of said rotary cam member from said first non-activated position to said second activated position so as to in turn prevent movement of said trigger means from said first non-activated position to said second activated position, while when said axially movable means is disposed at said retracted position, said rotary cam member does not engage said axially movable means whereby said rotary cam member and said trigger means are able to be moved to their respective activated positions.

10. The tool as set forth in claim 1, further comprising:

transformer means disposed within said handle means, and interposed between and interconnecting said electric cord and said electrical switch means so as to provide said tool with electrical power having a predetermined voltage level.

11. The tool as set forth in claim 1, further comprising:

electrical rectifying and transforming means operatively connected to said one end of said electric cord which is operatively connected to said power source so as to provide said tool with electrical power having predetermined voltage and current characteristics.

12. A portable fastener driver tool, comprising:

a housing having handle means provided thereon;

a cylinder provided within said housing and slidably supporting a piston within a first part thereof and defining a combustion chamber within a second part thereof;

a liquid gas container disposed within said housing for supplying inflammable gas into said combustion chamber of said cylinder;

an ignition plug for igniting said inflammable gas conducted into said combustion chamber of said cylinder;

a driving rod fixed to said piston such that said driving rod is driven forward along a drive axis and out of said cylinder as a result of the combustion of said inflammable gas conducted into and ignited within said combustion chamber of said cylinder;

fastener magazine means provided in front of said driving rod, when said driving rod is disposed in a fully retracted state, for serially supplying fasteners one by one to said drive axis such that said fasteners can be serially driven as a result of the successive forward movements of said driving rod;

electrical switch means mounted upon said handle means of said housing for movement between ON and OFF states; and an electric cord having one end thereof operatively connected to a power source which is external of said tool for receiving electrical power from said external power source, and an opposite end thereof operatively connected to said housing for supplying said electrical power to said ignition plug through said electrical switch means when said electrical switch means is disposed in said ON state.

13. The tool as set forth in claim 12, further comprising:

fan means disposed within said combustion chamber for agitating gases within said combustion chamber.

14. The tool as set forth in claim 13, further comprising:

electrical connection means connecting said fan means to said electrical switch means such that said electrical switch means controls the supply of said electrical power to both said ignition plug and said fan means.

15. The tool as set forth in claim 12, further comprising:

transformer means disposed within said handle means of said housing, and interposed between and interconnecting said electric cord and said electrical switch means so as to provide said tool with electrical power having a predetermined voltage level.

16. The tool as set forth in claim 12, further comprising:

electrical rectifying and transforming means operatively connected to said one end of said electric cord which is operatively connected to said power source so as to provide said tool with electrical power having predetermined voltage and current characteristics.

17. A portable fastener driver tool, comprising:

a housing having handle means provided thereon;

a combustion chamber provided within said housing;

fan means disposed within said combustion chamber for agitating gases within said combustion chamber;

a fuel container disposed within said housing for supplying fuel into said combustion chamber of said housing;

an ignition plug disposed within said combustion chamber for igniting said fuel conducted into said combustion chamber;

a driving rod movably disposed within said housing such that said driving rod is driven forwardly along a drive axis and out of said housing as a result of the combustion of said fuel conducted into and ignited within said combustion chamber of said housing;

fastener magazine means provided in front of said driving rod, when said driving rod is disposed in a fully retracted position, for serially supplying fasteners one by one to said drive axis such that said fasteners can be serially driven as a result of the successive forward movements of said driving rod;

an electric cord having one end thereof operatively connected to a power source which is external of said tool for receiving electrical power from said external power source, and a second opposite end thereof operatively connected to said housing for supplying said electrical power to said tool; and electrical switch means mounted upon said handle means of said housing for movement between ON and OFF states and electrically connected to said second opposite end of said electric cord for controlling the distribution of said electrical power to both said ignition plug and said fan means disposed within said combustion chamber of said housing.

18. The tool as set forth in claim 17, further comprising:

trigger means mounted upon said handle means and operatively connected to said electrical switch means for activating said electrical switch means and said tool when a fastener is to be driven by said driving rod of said tool and into a substrate; and means axially movable upon said housing between extended and retracted positions, and operatively associated with said trigger means, for preventing movement of said trigger means and activation of said electrical switch means when said axially movable means is not engaged with a substrate into which a fastener is to be driven whereby said axially movable means is disposed at said extended position, and for permitting movement of said trigger means and activation of said electrical switch means when said axially movable means is engaged with a substrate into which a fastener is to be driven whereby said axially movable means is disposed at said retracted position.

19. The tool as set forth in claim 18, wherein:

a rotary cam member is pivotally mounted within said housing;

said trigger means comprises an extension portion which is pivotally connected to said rotary cam member such that when said trigger means is pulled so as to activate said electrical switch means, said rotary cam member will be pivoted from a first non-activated position, corresponding to a first non-activated position of said trigger means, to a second activated position corresponding to a second activated position of said trigger means; and said axially movable means blockingly engages said rotary cam member when said axially movable means is disposed at said extended position so as to prevent pivotal movement of said rotary cam member from said first non-activated position to said second activated position so as to in turn prevent movement of said trigger means from said first non-activated position to said second activated position, while when said axially movable means is disposed at said retracted position, said rotary cam member does not engage said axially movable means whereby said rotary cam member and said trigger means are able to be moved to their respective second activated positions.

20. The tool as set forth in claim 17, further comprising:

transformer means disposed within said handle means of said housing, and interposed between and interconnecting said second opposite end of said electric cord and said electrical switch means so as to provide said tool with electrical power having a predetermined voltage level.

* * * * *